US006380679B1

(12) United States Patent
Leers et al.

(10) Patent No.: US 6,380,679 B1
(45) Date of Patent: Apr. 30, 2002

(54) SHORT-ARC DISCHARGE LAMP WITH A STARTING ANTENNA

(75) Inventors: Dieter Leers, Stolberg; Klaus Lohn, Simmerath; Martin Ossmann, Aachen, all of (DE); Johannes M. De Regt, Cadier en Keer (NL); Günther H. Derra, Aachen (DE); Hubertus C. M. Van Den Nieuwenhuizen, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/270,446

(22) Filed: Mar. 16, 1999

(30) Foreign Application Priority Data

Mar. 19, 1998 (EP) ..... 98200887

(51) Int. Cl.[7] ..... H01J 7/30

(52) U.S. Cl. ..... 313/594; 315/60; 315/57; 313/601

(58) Field of Search ..... 315/47, 60, 267, 315/55, 57; 313/25, 594, 607, 234, 591, 601, 602, 595

(56) References Cited

U.S. PATENT DOCUMENTS 3,764,848 A * 10/1973 Berlincourt ..... 315/55
3,828,214 A 8/1974 Keeffe et al. ..... 313/1
4,053,809 A 10/1977 Fridrich et al. ..... 313/198
4,277,725 A * 7/1981 Sneijers ..... 315/73
4,322,658 A * 3/1982 Minarczyk ..... 315/47
4,433,271 A * 2/1984 Inoue et al. ..... 315/63
4,445,073 A * 4/1984 Wyner et al. ..... 315/56
4,658,184 A * 4/1987 Gaspar ..... 315/47
4,686,421 A * 8/1987 Scholz ..... 315/73
4,812,714 A * 3/1989 Keeffe et al. ..... 315/60
4,818,915 A * 4/1989 Zaslavsky et al. ..... 315/60
5,079,479 A * 1/1992 Weske et al. ..... 313/594
5,248,918 A 9/1993 Dakin et al. ..... 315/248
5,811,933 A * 9/1998 VanDen Nieuwenhuizen et al. .. 313/570
5,942,840 A * 8/1999 Steere et al. ..... 313/25
5,990,599 A * 11/1999 Jackson et al. ..... 313/25

* cited by examiner

*Primary Examiner*—Michael H. Day
(74) *Attorney, Agent, or Firm*—Dicran Halajian

(57) ABSTRACT

A short-arc discharge lamp (1) is provided with a translucent lamp vessel (10) which is closed in a gas-tight manner and which is provided with an ionizable fill. A first and a second electrode (11*a*, 11*b*) are arranged in the lamp vessel (10) which are each connected to its own current conductor (12*a*, 12*b*) which extends to outside the lamp vessel. A starting antenna (2) is arranged near to the lamp vessel, which antenna is connected to a further current conductor (24). The starting antenna comprises an antenna container (20) and a further electrode (22) which antenna container (20) is closed in a gas-tight manner and contains an ionizable fill, the further electrode (22) being connected to the further current conductor (24). This makes it possible to realize a shorter reignition time by means of a higher reignition voltage on the starting antenna while spark-over from the starting antenna (2) to the lamp vessel (10) is avoided.

17 Claims, 4 Drawing Sheets

SHORT-ARC DISCHARGE LAMP WITH A STARTING ANTENNA

BACKGROUND OF THE INVENTION

The invention relates to a unit comprising a short-arc discharge lamp and a starting antenna, the short-arc discharge lamp including a translucent, gas-tight lamp vessel with an ionizable fill. A a first and a second electrode are arranged in the lamp vessel of which either one of the two electrodes is connected to a current conductor of its own extending to outside the lamp vessel, a starting antenna connected to a further current conductor being arranged near to the lamp vessel.

Such a unit comprising a short-arc discharge lamp and starting antenna is known from U.S. Pat. No. 4,053,809. A short-arc discharge lamp, hereinafter to be denoted lamp, is understood to mean a discharge lamp of which the distance between the electrodes is smaller than half the widest outside diameter of the lamp vessel. The short discharge arc makes a proper bundling of the light generated by the lamp possible. This renders the lamp highly suitable as, for example, a projection lamp or a car headlamp. Short-arc discharge lamps have a fill that adopts a very high pressure of the order of several tens of bars and upwards during the operation of the lamp. The fact that the high pressure decreases only gradually after switch-off renders it difficult to reignite the lamp shortly afterwards. With the known lamp, the lamp vessel has a central portion and neck-shaped end portions on either one of the two sides thereof. Alongside the lamp vessel is extended a metal conductor which is attached encircling one of the end portions at a distance from the central portion. The further current conductor to which the metal conductor is connected is in its turn connected to one of the current conductors of the electrodes. The metal conductor realizes a shortening of the time (reignition time) that is necessary for reigniting the lamp and therefore operates as a starting antenna The reignition time is shorter as a higher reignition voltage is applied to the starting antenna. The permissible reignition voltage on the starting antenna, however, is limited because spark-over from the starting antenna to the lamp vessel occurs when voltages are too high. This causes damage to the lamp vessel which considerably shortens the life of the lamp.

SUMMARY OF THE INVENTION

It is an object of the invention to reduce the reignition time possible and to avoid spark-over from the starting antenna to the lamp vessel. According to the invention the starting antenna has a gas-tight antenna container with an ionizable fill and includes a further electrode which is connected to the further current conductor. When the further current conductor produces a reignition voltage, the further electrode causes an ionization to occur of the ionizable fill of the antenna container. The fill of the antenna container has then become conductive, so that this generates an electric field in the lamp vessel similarly to a metal conductor. Surprisingly, however, it has appeared that with the unit according to the invention a considerably higher reignition voltage can be produced on the starting antenna without spark-over from the starting antenna to the lamp vessel. This makes a further reduction of the reignition time possible.

It is noted from U.S. Pat. No. 5,248,918 that an electrodeless HID lamp is known in which, by means of magnetic induction, an electric discharge in the ionizable fill of the lamp vessel is maintained during operation. Due to the lack of electrodes, such lamps in cold state are generally harder to ignite than conventional lamps which do have electrodes. An important cause of this is a shortage of free electrons in the lamp vessel of the electrodeless lamp in that state. To improve the ignition of this electrodeless lamp, a tube containing an ionizable medium is attached to the lamp vessel. When the electrodeless lamp is ignited, a high voltage is offered at a free end of the tube. The measure according to the invention is especially effective when the short-arc discharge lamp is reignited in hot condition. For the hot reignition of short-arc discharge lamps, a lack of free electrons does not play any role.

Furthermore, there is noted that from U.S. Pat. No. 3,828,214 is known a high-pressure sodium lamp of which the lamp vessel is included in an envelope which contains an ionizable fill. Further electrodes are arranged inside the envelope. With this lamp, the distance between the electrodes of the lamp is considerably larger than the diameter of the lamp vessel. When a voltage is applied to the lamp, the fill in the envelope enveloping the lamp vessel is ionized. The fill in the lamp vessel is heated as a result, so that the starting voltage of the high-pressure sodium lamp drops. In this patent application is stated that the ionized plasma in the envelope acts as a conductive body. A conductive body, for example, a conducting strip, in the vicinity of the lamp vessel is used in high-pressure sodium lamps to shorten the distance to be bridged on ignition. First a capacitive discharge arises over a relatively short distance between the conductive strip and a neighboring electrode. After that, the discharge in the lamp vessel is extended to between the electrodes in the lamp vessel.

Experimental examination of the unit according to the invention has shown the inventors that after a reignition voltage is applied to the starting antenna, there is first an initial discharge over a relatively long path along an inside surface of the wall of the lamp vessel. Subsequently, this initial discharge turns into an arc discharge between the electrodes.

In a short-arc discharge lamp the density of the ionizable fill in hot condition is very high. This makes it difficult to sufficiently accelerate free electrons present in the lamp vessel, so as to realize a discharge. Consequently, a rise of the temperature of the lamp vessel when the short-arc discharge lamp is ignited actually leads to an increase of the starting voltage. In an advantageous embodiment of the unit according to the invention, the lamp vessel is for this reason arranged outside the antenna container. As a result, the heating of the lamp vessel as a result of the discharge in the antenna container is substantially avoided.

For counteracting optical losses, the antenna container is preferably made of a translucent material, for example, a ceramic material such as monocrystalline metal oxide, for example, sapphire, polycrystalline metal oxide, for example, translucent gas-tight aluminum oxide (DGA), yttrium aluminum grenate (YAG) or yttrium oxide (YOX), or polycrystalline non-oxidic material such as aluminum nitride (AlN). Glass, for example quartz glass, is also suitable as a translucent material and has the additional advantage that it provides a relatively large freedom of form of the starting antenna.

In a unit according to the invention, the nature and intensity of the radiation generated in the antenna container for achieving a shorter reignition time is not of prime importance. However, for achieving a short ignition time when the lamp is ignited in cold condition, in the absence of ambient light, it is favorable if the starting antenna in an activated condition generates UV radiation, preferably in a wavelength band from 190 to 260 nm. For example, the starting antenna has a fill of mercury and argon.

The further electrode may be included in the antenna container and connected to the further current conductor via a gas-tight lead-in. However, an embodiment in which the further electrode is attached to an outside surface of the antenna container is easier to manufacture. A gas-tight lead-in is then not necessary. In addition, this enhances the options with respect to the materials for the further electrode and with respect to the components of the fill, because the wall of the antenna container in this case avoids any chemical interactions between the further electrode and the fill inside the antenna container.

The reignition voltage produced on the starting antenna is, for example, a high-frequency A.C. voltage, but, on the other hand, may be a possibly recurrent, pulsatory voltage.

In an advantageous embodiment, the unit according to the invention is further characterized by voltage-transforming means in which the current conductors are connected to an input of the voltage-transforming means and in that the further current conductor is connected to an output of their own of the voltage-transforming means. Since the unit includes voltage-transforming means, it may be connected to a power supply which needs to supply only a relatively low voltage both on ignition of the lamp and during nominal operation of the lamp; Therefore, relatively cost-effective components may be used for the power supply. The voltage-transforming means are arranged, for example, as a transformer, for example having a primary winding and a secondary winding around a core of magnetizable material. On the other hand, the transforming means may be arranged as a spiral line transformer.

It is attractive if the voltage-transforming means are formed by a piezoelectric transformer. For a frequency near to its resonance frequency, a transformer of this type produces a considerably higher output voltage than for a frequency that deviates more from the resonance frequency. This is especially advantageous in embodiments in which the transformer and the lamp are connected to the same power supply, because in this manner the voltage on the output of the transformer may be changed without this having an appreciable effect on the voltage on the electrodes of the lamp.

An attractive embodiment of the unit according to the invention is characterized in that the lamp vessel has a relatively wide central portion and on either one of the two sides thereof neck-shaped end portions, with the electrodes being arranged in the central portion of the lamp vessel, the current conductors extending each through a respective end portion, and the antenna container of the starting antenna being a tube which encircles one of the end portions near to the central portion. This double-sided short-arc discharge lamp lends itself fairly easily for manufacture on an industrial scale.

Owing to the short distance between the electrodes, the short-arc discharge lamp is eminently suitable for use in a unit with a reflector, for example, for projection purposes.

Preferably, the unit includes the above-described double-sided short-arc discharge lamp. A practical and compact embodiment of such a unit is characterized in that the reflector is a converging reflector having an optical axis, a light emission window and, opposite this window, a further window with the reflector encircling the central portion of the lamp vessel, the neck-shaped portions of the lamp vessel extending along the optical axis and the end portion encircled by the starting antenna extending outwardly through the further window.

These and other aspects of the invention will be apparent from and elucidated with reference to the embodiments described hereinafter.

DETAILED DESCRIPTION OF THE PREFERRED EMBODIMENTS

Figure 1:
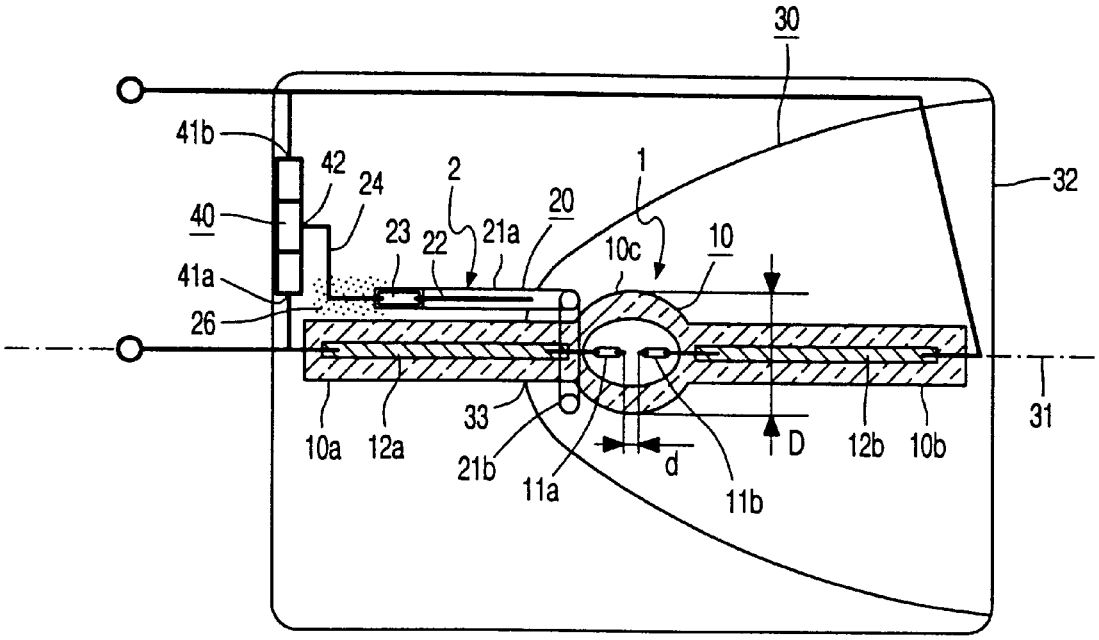
FIG. 1 shows in longitudinal section a first embodiment of a unit comprising a short-arc discharge lamp and a starting antenna according to the invention, with the unit further including a reflector and voltage-transforming means.

FIG. 1 shows a unit comprising a short-arc discharge lamp 1 and a starting antenna 2. The short-arc discharge lamp comprises a translucent gas-tight lamp vessel 10 with an ionizable fill. In this case the fill contains one or more rare gases, argon here under a filling pressure of 100 Mbar, at least 0.2 mg/mm$^3$ mercury and, for example, $10^{-6}10^{-4}$? mol/mm$^3$ of one or more of the halogens Cl, Br, I, here in the form of mercury bromide. The lamp vessel in FIG. 1 is made of quartz glass but may be of a different ceramic material. In the lamp vessel 10 are arranged a first and a second electrode 11*a*, 11*b* having a mutual distance d of 1 mm. The lamp vessel 10 has a widest outside diameter D of 9 mm. The mutual distance d between the electrodes is in the present embodiment therefore smaller than half the widest outside diameter D of the lamp vessel. Either one of the two electrodes 11*a*, 11*b* is connected to a current conductor 12*a*, 12*b* of its own which extends to outside the lamp vessel 10. In the vicinity of the lamp vessel 10 is arranged a starting antenna 2 which is connected to a further current conductor 24.

In the embodiment shown in FIG. 1 the lamp vessel 10 of the short-arc discharge lamp has a relatively wide central part 10*c* and on either side thereof neck-shaped end portions 10*a*, 10*b* having an outside diameter of 6.1 mm. The electrodes 11*a*, 11*b* are arranged in the central portion 11*c* of the lamp vessel 10, and the current conductors 12*a*, 12*b* extend each through its own end portion 10*a*, 10*b*.

Figure 2A:
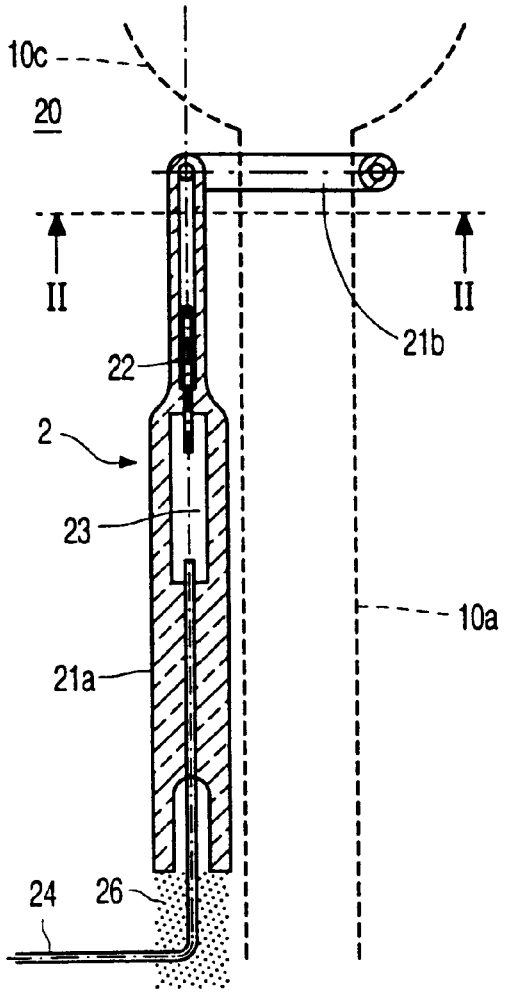
FIG. 2A shows in more detail the starting antenna of the first embodiment also in longitudinal section.
Figure 2B:
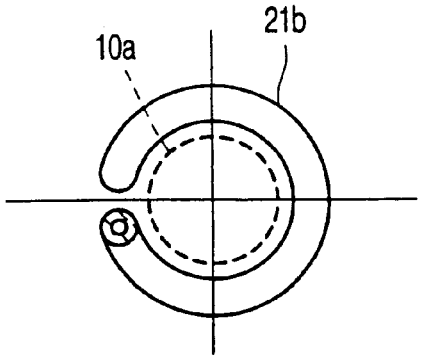
FIG. 2B shows the starting antenna in cross-section along II—II in FIG. 2A.

The starting antenna 2 is shown in more detail in FIGS. 2A and 2B. In these Figures is also shown in a dotted line a part 10*a*, 10*c* of the lamp vessel 10. The starting antenna 2 has a gas-tight antenna container 20 which contains an ionizable fill here formed by argon under a filling pressure of 100 Mbars. In another embodiment, the ionizable fill also includes, for example, 0.5 mg of mercury. The starting antenna 2 furthermore has a further electrode 22 which is connected to the further current conductor 24. In this case the starting antenna 2 has an internal electrode 22 which is arranged as a tungsten pin. The pin 22 is connected to the further current conductor 24 of molybdenum via a strip-shaped lead-in element 23 also of molybdenum. In another embodiment, there is no tungsten pin and a free end of the lead-in element serves as the internal electrode. The antenna container 20 of the starting antenna 2 is here a quartz glass tube which has a wall thickness of 0.4 mm. The tube has a first, relatively wide, part 21*a* which has a length of 25 mm and an inside diameter of 1.6 mm which extends along the neck-shaped end portion 10*a*. It has a second, relatively narrow, part 21*b* encircling the neck-shaped end portion 10*a*, which part 21*b* has an inside diameter of 0.6 mm near to the central part 10*c*. In this case the second part 21*b* makes 360? bend around the end portion 10*a*.

In the embodiment shown the lamp vessel 10 is arranged outside the antenna container 20.

The unit shown in FIG. 1 furthermore has a reflector 30. The reflector is a converging reflector 30 having an optical axis 31, a light emission window 32 and a further window 33 opposite the light emission window. In this case the reflector is a parabolic reflector. The reflector 30 surrounds the central portion 10*c* of the lamp vessel 10. One of the end portions 10*a* extends outwardly through the further window 33 of the reflector 30.

Figure 3:
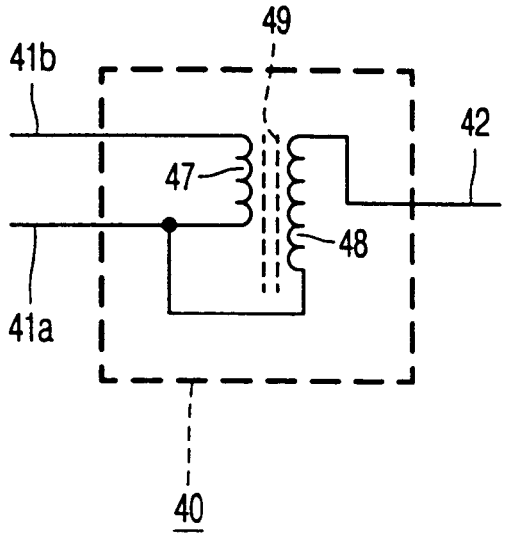
FIG. 3 shows in more detail the voltage-transforming means of the unit shown in FIG. 1.

The unit furthermore comprises voltage-transforming means 40. The current conductors 12*a*, 12*b* are each connected to an input 41*a*, 41*b* of their own of the voltage-transforming means 40 and the further current conductor 24 is connected to an output 42 of the voltage-transforming means. The voltage-transforming means 40 are arranged here as an inductively operating transformer with a primary winding 47 and a secondary winding 48 around a core 49 of soft-magnetic material (see FIG. 3).

The reignition time of the unit according to the invention as a function of the reignition voltage offered on the starting antenna was examined. This relation was also examined for a unit not according to the invention for which the starting antenna is arranged as a solid conductor of a $Fe_{70}Cr_{25}Al_5$ (weight %) alloy.

With the unit not according to the invention there was spark-over from the starting antenna to the lamp vessel when the starting voltage exceeded 5 kV. This rendered it more difficult to realize a shorter reignition time than 45 s in practice for the lamp not according to the invention. With the unit according to the invention and a reignition voltage of 8 kV peak on the starting antenna 20 and an starting voltage of 800 V peak between the electrodes, a reignition time of 30 s was realized. No spark-over occurred from the starting antenna 20 to the lamp vessel 10. Spark-over from the further current conductor 24 to the neck-shaped portion 10*a* is avoided with kit 26 based on a ceramic material applied for insulation purposes.

Figure 4A:
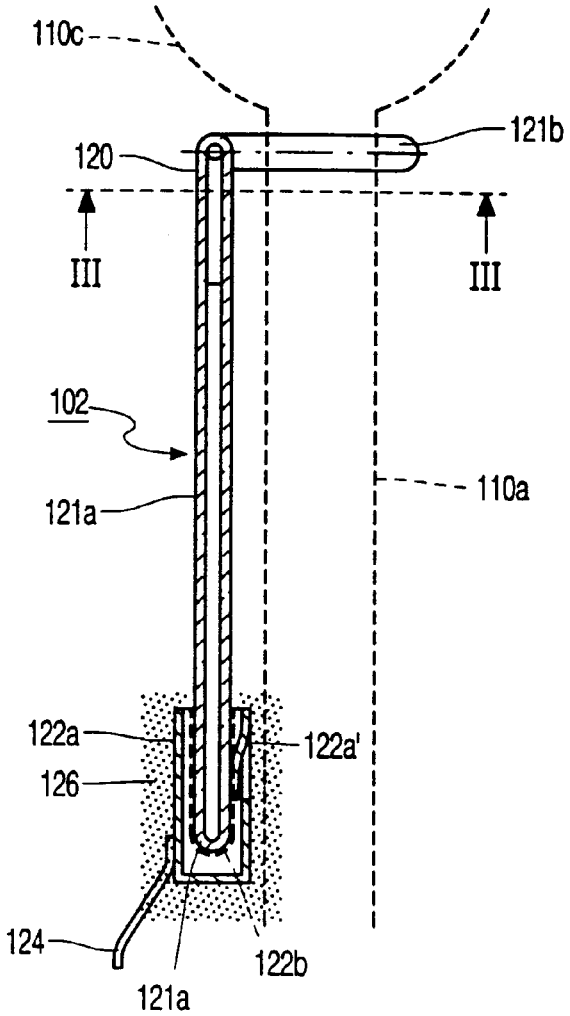
FIG. 4A shows in more detail the ignition antenna of a second embodiment of the unit according to the invention.
Figure 4B:
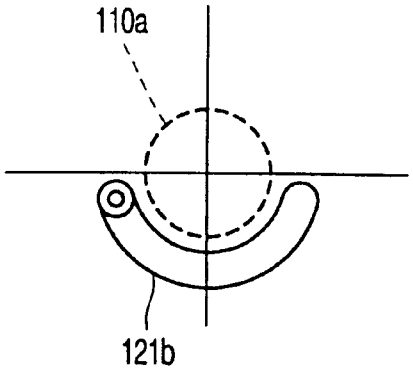
FIG. 4B shows the ignition antenna in cross-section along III—III in FIG. 4A.

Elements in FIGS. 4A and 4B corresponding to the elements of FIGS. 1, 2A or 2B have reference numerals 100 up. These Figures show the starting antenna 102 in a second embodiment of the unit according to the invention. Dotted lines therein show a part 110*a*, 110*c* of the lamp vessel 110 of the short-arc discharge lamp 101. In this embodiment, the antenna container 120 of the starting antenna 102 is completely made of a quartz glass tube having an inside diameter of 0.6 mm and a wall thickness of 0.45 mm. The electrode 122 is here attached to the outside surface of the antenna container. In this case the electrode 122 is arranged as a metal tube 122*a* which is clamped onto the free end 121*a*' of the straight part 121*a* of the antenna container 120 by means of a resilient finger 122*a*' moving inwardly. The bus 122*a* is capacitively coupled to the ionizable fill in the antenna container 120. A still better capacitive coupling is obtained in that the free end 121*a*' is covered with a coating 122*b* of a metal, platinum in this case.

Figure 5:
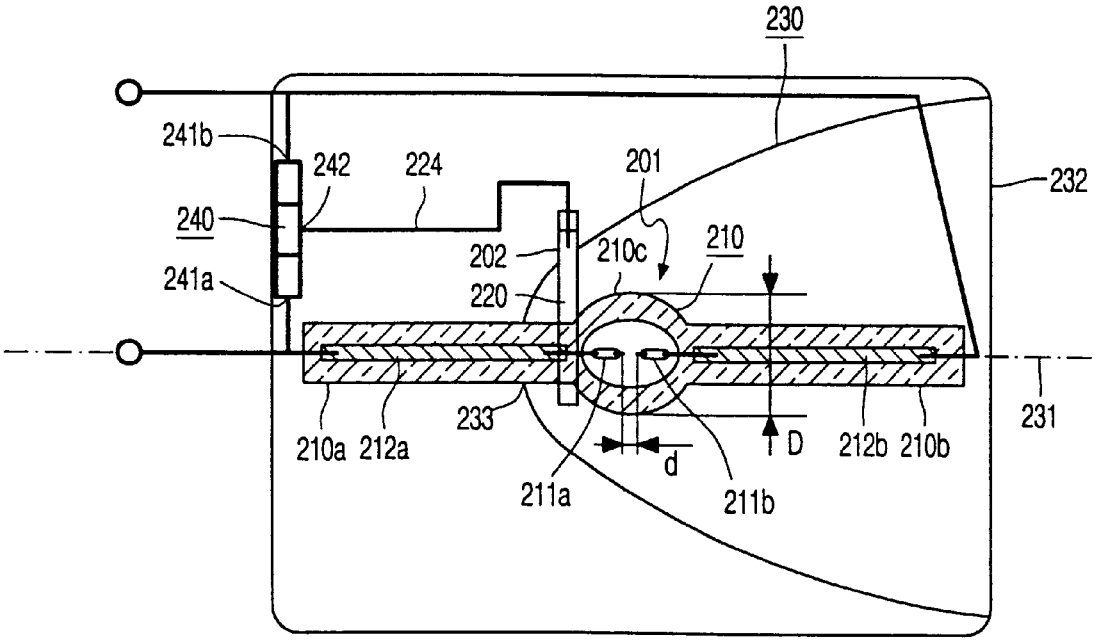
FIG. 5 shows in longitudinal section a third embodiment of a unit comprising a short-arc discharge lamp and a starting antenna according to the invention, with the unit further, including a reflector and voltage-transforming means.
Figure 6:
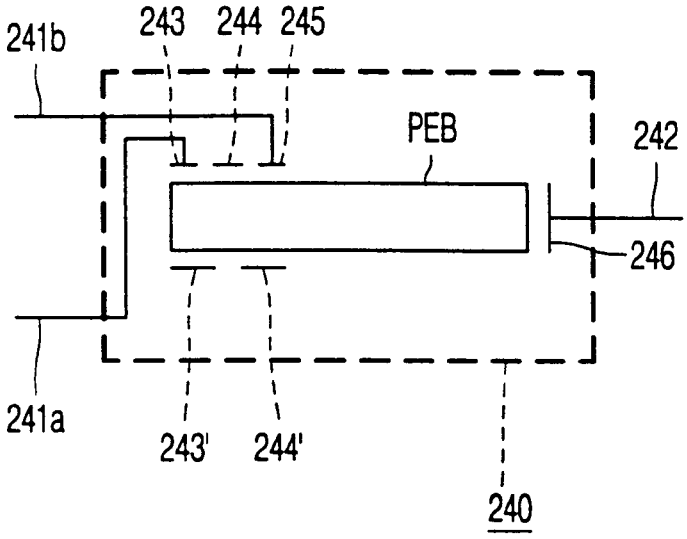
FIG. 6 shows in more detail the voltage-transforming means of the unit shown in FIG. 5.

A third embodiment of the unit comprising a short-arc discharge lamp and starting antenna according to the invention is shown in FIG. 5. Elements therein corresponding to those of FIG. 1 have a reference numeral that is 200 up. In this embodiment, the antenna container 220 of the starting antenna is arranged as a straight tube of a ceramic material, in this case aluminum oxide. The antenna container 220 is arranged transversely to the end portion 210*a* of the lamp vessel 210. The voltage-transforming means 240 are formed here by a piezoelectric transformer (shown diagrammatically in FIG. 6).

Obviously, within the framework of the claims there are many variations possible. For example, in a variant of a unit comprising a short-arc discharge lamp and a reflector according to the invention, the starting antenna is arranged near to the lamp end portion turned towards the light emission window. In that variant, the further current conductor is extended, for example, radially from the antenna container to the reflector and is led via a lateral opening in the reflector to the voltage-transforming means or to another high-voltage source.

What is claimed is:

1. A unit comprising a short-arc discharge lamp and a starting antenna, the discharge lamp including a translucent, gas-tight lamp vessel with a first ionizable fill, and a first electrode and a second electrode which are arranged in the lamp vessel on a longitudinal axis of the lamp vessel and are respectively connected to a first current conductor and a second current conductor extending to outside the lamp vessel, wherein the starting antenna is connected to a voltage-transforming means through a third current conductor and comprises a gas-tight antenna container having a tube shape with at least part of the length of the tube extending parallel to said longitudinal axis of the lamp, the gas-tight antenna container containing a second ionizable fill and comprising a third electrode which is connected to the third supply current conductor.

2. A unit as claimed in claim 1, wherein the lamp vessel is arranged outside the antenna container.

3. A unit as claimed in claim 1 wherein the antenna container is made of a translucent material.

4. A unit as claimed in claim 1 wherein the starting antenna in an activated state generates UV radiation.

5. A unit as claimed in claim 1 wherein the third electrode is attached to an outside surface of the antenna container.

6. A unit as claimed in claim 1 wherein the first and second current conductors are connected to respective inputs of the voltage-transforming means and the third current conductor is connected to an output of the voltage-transforming means.

7. A unit as claimed in claim 6, wherein the voltage-transforming means are formed by a piezoelectric transformer.

8. A unit as claimed in claim 1 wherein the lamp vessel has a central portion and end portions located at sides of the central portion, the first and second electrodes being arranged in the central portion of the lamp vessel, the first and second current conductors extending through respective ones of said end portions.

9. A short-arc discharge lamp comprising a starting antenna, a converging reflector and a lamp vessel with a central portion and two end portions, the lamp vessel having a first electrode and a second electrode connected respectively to a first current conductor and a second current conductor, both current conductors extending outside the lamp vessel, the starting antenna having an antenna container containing an ionizable fill, the ionizable fill being in electrical contact with a third electrode which is connected by a third current conductor to a transformer, the reflector having an optical axis and a light emission window which is opposite a further window, the reflector encircling the central portion of the lamp vessel, the two end portions of the lamp vessel extending along the optical axis, and the central portion of the lamp vessel being opposite the antenna container, the antenna container extending outwardly through the further window.

10. A unit comprising a discharge lamp and a starting antenna, the discharge lamp including a translucent, gas-tight lamp vessel with a first ionizable fill, and a first electrode and a second electrode which are arranged in the lamp vessel and are respectively connected to a first current conductor and a second current conductor extending to outside the lamp vessel, wherein the starting antenna is connected to a voltage-transforming means through a third current conductor and comprises a gas-tight antenna container containing a second ionizable fill and a third electrode which is connected to the third supply current conductor, further comprising a converging reflector having an optical axis, a light emission window which is opposite a further window, the reflector encircling a central portion of the lamp vessel, two end portions of the lamp vessel extending along the optical axis, and one of the end portions being encircled by the antenna container of the starting antenna and extending outwardly through the further window.

11. A short-arc discharge lamp comprising:

a translucent gas-tight lamp vessel with a first ionizable fill, first and second electrodes arranged in said lamp vessel on a longitudinal axis of said lamp vessel and connected to respective current conductors which extend to outside the lamp vessel, a starting antenna comprising a gas tight antenna container containing a second ionizable fill, and an antenna electrode connected to said second ionizable fill and to a current conductor extending to outside the antenna container, said antenna container having a tubular shape and extending along said longitudinal axis, and a transformer which is connected to said antenna electrode.

12. A short-arc discharge lamp comprising:

a lamp vessel containing a first ionizable fill;

a first electrode and a second electrode which are arranged in the lamp vessel;

a starting antenna having a tubular antenna container at least partly extending parallel to the longitudinal axis and containing a second ionizable fill, a third electrode connected to said second ionizable fill, and a transformer which is connected to said third electrode.

13. The discharge lamp of claim 12, wherein inputs of the transformer are connected to the first electrode and the second electrode, and an output of the transformer is connected to the third electrode.

14. The discharge lamp of claim 12, wherein said lamp vessel has a central portion and end portions, said central portion being located between said end portions, and wherein an end of said starting antenna is positioned substantially opposite a transition point between one of the end portions and the central portion.

15. A unit comprising a short-arc discharge lamp and a starting antenna, the discharge lamp including a lamp vessel with a first ionizable fill, and a first electrode and a second electrode respectively connected to a first current conductor and a second current conductor extending to outside the lamp vessel, wherein the starting antenna is connected to a third electrode which is connected to a transformer through a third current conductor and comprises a gas-tight antenna container having a circular shape, the gas-tight antenna container containing a second ionizable fill and surrounding all or part of the lamp vessel.

16. The discharge lamp of claim 15 wherein said lamp vessel has a central portion and end portions, said central portion being located between said end portions, and wherein an end of said starting antenna is positioned substantially opposite a transition point between one of the end portions and the central portion.

17. The discharge lamp of claim 15 wherein a converging reflector surrounds the lamp vessel, the reflector having an optical axis and a light emission window which is opposite a further window, the lamp vessel extending along the optical axis, the antenna container of the starting antenna extending outwardly through the further window and being positioned parallel to the optical axis.

* * * * *